United States Patent [19]

Murphy et al.

[11] 4,100,083

[45] Jul. 11, 1978

[54] LUBRICANT COMPOSITIONS CONTAINING AN AMINE SALT OF A HALF ESTER OF SUCCINIC ACID

[75] Inventors: William R. Murphy, West Trenton, N.J.; Carleton N. Rowe, Yardley, PA

[73] Assignee: Mobil Oil Corporation, New York, N.Y.

[21] Appl. No.: 637,922

[22] Filed: Dec. 5, 1975

Related U.S. Application Data

[63] Continuation-in-part of Ser. No. 474,494, May 30, 1974, abandoned.

[51] Int. Cl.[2] ..... C10M 1/26

[52] U.S. Cl. ..... 252/34; 252/51.5 A

[58] Field of Search ..... 252/34, 51.5 A

[56] References Cited

U.S. PATENT DOCUMENTS

| | | | |
|---|---|---|---|
| 2,585,877 | 2/1952 | Trigg et al. | 252/34 |
| 2,610,205 | 9/1952 | Trigg et al. | 260/484 |
| 2,689,828 | 9/1954 | Smith et al. | 252/34 |
| 2,830,021 | 4/1958 | Smith et al. | 252/34 |
| 3,121,057 | 2/1964 | Gee et al. | 252/51.5 A X |
| 3,184,474 | 5/1965 | Catto et al. | 252/51.5 A X |
| 3,280,033 | 10/1966 | Drummond | 252/51.5 A |
| 3,522,179 | 7/1970 | Le Suer | 252/51.5 A |
| 3,658,707 | 4/1972 | Delafield et al. | 252/56 D X |
| 3,936,480 | 2/1976 | Demoures et al. | 252/51.5 A X |
| 3,950,341 | 4/1976 | Okamoto et al. | 252/51.5 A X |
| 3,951,977 | 4/1976 | Plasek et al. | 252/51.5 A X |
| 3,991,056 | 11/1976 | Okamoto et al. | 252/51.5 A X |
| 4,053,426 | 10/1977 | Davis et al. | 252/34 |

*Primary Examiner*—Daniel E. Wyman
*Assistant Examiner*—Thomas A. Waltz
*Attorney, Agent, or Firm*—Charles A. Huggett; Raymond W. Barclay; Claude E. Setliff

[57] ABSTRACT

Lubricant compositions comprising an oil of lubricating viscosity and a minor proportion of water containing in an amount sufficient to counteract the accelerating effect of water on metal fatigue an amine salt of a half-ester of a substituted succinic acid. Greases containing the above-described amine salts are also provided.

10 Claims, No Drawings

LUBRICANT COMPOSITIONS CONTAINING AN AMINE SALT OF A HALF ESTER OF SUCCINIC ACID

CROSS REFERENCE TO RELATED APPLICATIONS

This application is a continuation-in-part of U.S. application Ser. No. 474,494, filed May 30, 1974, now abandoned.

BACKGROUND OF THE INVENTION

1. Field of the Invention

This invention relates to lubricant compositions and, more particularly, to lubricant compositions in the form of oils of lubricating viscosity and greases containing such oils as vehicles and wherein these lubricants are contaminated by undesirable quantities of water which have an accelerating effect on metal fatigue.

2. Description of the Prior Art

Lubricant compositions, such as oils and greases, are often found to contain appreciable quantities of water, resulting in a deleterious effect on the fatigue life of metals, such as bearings, gears and other moving machinery parts. The presence of such contaminating quantities of water if found to result from condensation occasioned by heat and subsequent cooling of the lubricant in the course of performing its function. In many instances, the presence of water may be found in the lubricant in amounts as much as from 0.01% to about 5%, by weight. The ability, therefore, to provide an effective additive to counteract the accelerating effect of water in the lubricant on metal surfaces is therefore highly desirable.

No prior art is known which discloses the lubricant compositions of this invention. This is not surprising, since metal fatigue and its prevention are very special problems. Consequently, few good additives having anti-fatigue properties are known.

U.S. Pat. No. 3,184,474 teaches a lubricant composition containing a product made from alkenyl succinic acid or anhydride, a polyhydric material and a polyamine. The differences between this product and that of the present application are clear. Since patentee was dealing with polyfunctional alcohols and amines, the final product had to be a complex mixture of materials. Furthermore, the reaction with the polyamine produced an amide. In contrast, the product of the present invention contains no complex mixture. It involves a single ester and a simple acidamine salt.

U.S. Pat. No. 2,830,021 teaches mineral oil composition containing aliphatic amine salts of monoalkyl esters of dimers of dienoic and trienoic fatty acids. Finally, U.S. Pat. No. 2,689,828 concerns mineral oils containing the amine salt of an aliphatic half ester of phthalic or alkyl-substituted phthalic acid.

SUMMARY OF THE INVENTION

In accordance with the invention, there is provided a lubricant composition comprising a lubricant and an anti-fatigue amount of an amine salt of a half ester of a succinic acid having the formula:

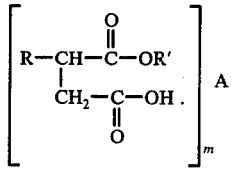

wherein $m$ is 1 or 2, R is an alkyl (i.e where the alkenyl group may be hydrogenated) or alkenyl group containing from 4 to 100 carbon atoms, preferably from 4 to 30 carbon atoms, R′ is an alkyl group containing from 1 to 40 carbon atoms, preferably from 1 to 20 carbon atoms and A is (1) a primary, secondary or tertiary hydrocarbyl monoamine containing from 1 to 20 carbon atoms or (2) a polyamine of the formula:

$$NH_2CH_2CH_2(R''NH)_xNH_2$$

wherein $x$ is 0 to 10 and R″ is an alkylene group containing 1 to 10 carbon atoms.

DESCRIPTION OF SPECIFIC EMBODIMENTS

In general, in most instances, the amine salt is employed in an amount from about 0.01% to about 10%, by weight, and preferably in an amount of from about 0.1% to about 5%, by weight of the total weight of the composition.

Of particular significance, is the ability to counteract the accelerating effect of water on metal fatigue achieved by employing the aforementioned amine salts of a half-ester of an alkenyl substituted succinic acid. These amine salts may be incorporated in lubricating media which may comprise liquid hydrocarbon oils in the form of either a mineral oil or a synthetic oil, or in the form of a grease, in which any of the aforementioned oils are employed as a vehicle. In general, mineral oils employed as the lubricant or grease vehicle may be of any suitable lubricating viscosity range as, for example, from about 45 SSU at 100° F to about 6,000 SSU at 100° F, and preferably from about 50 SSU at 210° F to about 250 SSU at 210° F. These oils may have viscosity indexes varying from below 0 to about 100 or higher. Viscosity indexes from about 70 to about 95 are preferred. The average molecular weights of these oils may range from about 250 to 800. Where the lubricant is to be employed in the form of a grease, the lubricating oil is generally employed in an amount sufficient to balance the total grease composition, after accounting for the desired quantity of the thickening agent, and other additive components to be included in the grease formulation.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl) adipate, di(butyl phthalate) fluorocarbons, silicate esters, silanes, esters of phosphorous-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis(p-phenoxy phenyl) ether, phenoxy phenylethers, etc.

The lubricating vehicles of the aforementioned greases of the present invention, containing the above-described amine salts, are combined with a grease-forming quantity of a thickening agent. For this purpose, a wide variety of materials may be employed. These thickening or gelling agents may include any of the conventional metal salts or soaps, which are dispersed in the lubricating vehicle in grease-forming quantities, in such degree as to impart to the resulting grease composition the desired consistency. Other thickening agents that may be employed in the grease formation may comprise the non-soap thickeners, such as surface modified clays and silicas, aryl ureas, calcium complexes and similar materials. In general, grease thickeners may be employed which do not melt and dissolve when used at the required temperature within a particular environment; however, in all other respects, any materials which are normally employed for thickening or gelling hydrocarbon fluids for forming greases, can be used in preparing the aforementioned improved greases in accordance with the present invention.

The half ester is made by reacting the alkenyl- or alkylsubstituted succinic acid or anhydride with a monohydric alkanol, containing 1 to 40 carbon atoms by simply mixing the two reactants and heating at from about 125° C to about 200° C in the case of acid, depending upon the alcohol used. Slightly higher temperatures are normally used when the anhydride is employed.

The amine salt is made by mixing the half ester and the amine at room temperature or higher and stirring until formation of the salt is complete. The temperature should not, however, be so high in this step that amidation takes place between the free acid function and the amine, since only the salt formation is desired.

Respecting both reactions, it is preferred that equivalent molar proportions of reactants be used. That is, in general 1 mole of alkenylsuccinic acid or anhydride is placed in a reactor and 1 mole of the monohydric alcohol is added thereto and heated at the desired temperature while stirring. Then to this 1 mole of half-ester 1 mole of amine is added for the salt formation. When the amine is a polyamine, two moles of the half-ester may be used to form product corresponding to:

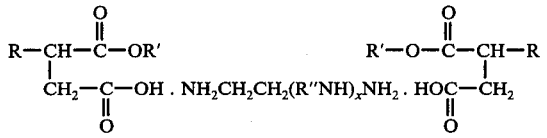

wherein R, R′, R″ and x are as hereinabove defined.

The preparation of the alkenylsuccinic anhydride (from which the acid may be prepared by known means) is described in U.S. Pat. No. 3,018,250. In general, approximately equimolar amounts of maleic anhydride and the olefinic material are simply heated together, using inert solvents, if desired or necessary, to lower the viscosity and to facilitate easy contact of the reactants.

Useful alcohols include methyl alcohol, ethyl alcohol, hexyl alcohol, pentadecyl alcohol, eicosyl alcohol, triacontyl alcohol and tetracontyl alcohol.

The amines that may be used in the practice of this invention include methyl-, dimethyl- and trimethylamine, butyl-, dibutyl- and tributylamine, decyl-, di(decyl)- and tri(decyl)amine, pentadecyl-, di(pentadecyl)- and tri(pentadecyl)amine, octadecyl-, di(octadecyl)- and tri(Octadecyl)amine, eicosyl-, dieicosyl- and trieicosylamine. The amine can also include a primary, secondary or tertiary amine having aryl, aralkyl or alkenyl groups. Polyamines useful herein include ethylene diamine, diethylenetriamine, triethylenetetraamine, tetraethylenepentamine and the like.

In order to demonstrate the ability of the amine salts of half-esters of alkenyl substituted succinic acids in counteracting the accelerating effect of water on metal-fatigue in lubricant compositions, comparative data were obtained, as shown in the following examples and tables.

EXAMPLE 1

Preparation of the Half-Ester

One mole of n-octenylsuccinic anhydride and one mole of methyl alcohol were placed in a suitable vessel and heated at reflux for 20 minutes while stirring.

Preparation of the Amine Salt

Into a 250 ml beaker were placed 60.9 grams (0.25 mole) of monomethyl n-octenylsuccinic acid with a magnetic stirring bar. Stirring was started and 46.5 grams (0.25 mole) of tributylamine were added slowly over a period of 10 minutes. Stirring was continued for one hour to give a quantitative yield (107.4 grams) of the tributylamine salt of monomethyl n-octenylsuccinic acid. The structure of the product was confirmed by the infrared spectrum.

EXAMPLE 2

By the method of Example 1, mono-sec-butyl tetrapropylsuccinic acid was prepared, and 127 grams (0.369 mole) thereof was allowed to react with 68.5 grams (0.369 mole) of tributylamine. The yield of the tributylamine salt of mono-sec-butyl tetrapropenylsuccinic acid was quantitative (195.5 grams). Infrared spectrum confirmed the structure.

The amine salts of half-esters of alkyl or alkenyl substituted succinic acids of the foregoing Examples 1 and 2 were next tested for the inhibition of water-induced metal-fatigue in oil and grease lubricants employing a rotating beam fatigue tester. For this test, midly notched SAE 52100 steel specimens 18 inches long and 0.25 inch notched diameter were employed. The individual specimens were completely immersed in the test lubricants which were maintained at a temperature of 120° F. During testing, the specimens were stressed by hanging weights and rotated at 6,000 rpm. Each lubricant was tested over a range of stress for which a range of characteristic fatigue lives were obtained. In Table 1 there is illustrated examples of the beneficial effects of the aforementioned amine salts in a water-contaminated mineral oil. This mineral oil comprised a straight SAE 20 oil containing only an antioxidant and approximately 0.009%, by weight, of water.

TABLE 1

| Lubricant Formulation | Fatigue Life (Cycles) at 110,000 p.s.i. nominal stress |
|---|---|
| Mineral Oil | 22. × $10^4$ |
| Mineral Oil + 0.05 Wt. % $H_2O$ | 7.5 × $10^4$ |
| Mineral Oil + 0.05 Wt. % $H_2O$ + 0.10 Wt. % Ex. 1 | 22. × $10^4$ |
| Mineral Oil + 0.05 Wt. % $H_2O$ + 0.10 Wt. % Ex. 2 | 14. × $10^4$ |
| Mineral Oil + 0.10 Wt. % Ex. 2 | 23. × $10^4$ |

As will be apparent from the comparative data of Table 1, the amine salts of the present invention are markedly effective in counteracting the accelerating effect of water on metal-fatigue in liquid lubricating compositions.

In order to further demonstrate the ability of the amine salts of the present invention in counteracting the accelerating effect of water on metal-fatigue in lubricating greases, the following comparative data, as shown in Table 2, were obtained. The grease employed comprised a lithium 1-hydroxystearate lead soap grease, containing oxidation, rust and corrosion inhibitors.The vehicle comprised a high viscous mineral oil.

TABLE 2

| Lubricant Formulation | Fatigue Life (Cycles) at 110,000 p.s.i. nominal stress |
|---|---|
| Grease | $17. \times 10^4$ |
| Grease + 5.0 Wt. % $H_2O$ | $11. \times 10^4$ |
| Grease + 5.0 Wt. % $H_2O$ + 0.5 Wt. % Ex. 1 | $15. \times 10^4$ |

As will be apparent from the comparative data of Table 2, the amine salts of the present invention are also markedly effective in counteracting the accelerating effect of water on metal-fatigue in lubricant grease compositions.

It is apparent from work done under the same conditions as Table 1 that the combination of functional groups are necessary for anti-fatigue properties. For example, using the same oil, same percentages of water and the same amount of additive, the following fatigue life cycles were determined:

| Additive | Fatigue Life (Cycles) at 100,000 p.s.i. nominal stress |
|---|---|
| Methyl Stearate | $9.0 \times 10^4$ |
| Tributylammonium Stearate | $11.0 \times 10^4$ |
| Stearic Acid | $10.0 \times 10^4$ |
| Stearyl Amine | $8.4 \times 10^4$ |
| Stearyl Alcohol | $9.4 \times 10^4$ |
| Eicosene | $7.2 \times 10^4$ |

While this invention has been described with reference to preferred compositions and components therefor, it will be understood by those skilled in the art that departure from the preferred embodiments can be effectively made and are within the scope of the specification.

We claim:

1. A lubricant composition consisting essentially of a major amount of a lubricant selected from the group consisting of lubricating oil and a grease therefrom and an anti-fatigue amount of an amine salt of a half ester of a succinic acid, the salt having the formula:

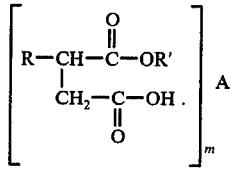

wherein $m$ is 1 or 2, R is an alkyl or alkenyl group containing from 4 to 100 carbon atoms, R′ is an alkyl group containing from 1 to 40 carbon atoms and A is (1) a hydrocarbyl monoamine or (2) a polyamine of the formula:

$$NH_2CH_2CH_2(R''NH)_xNH_2$$

wherein R″ is an alkylene group of from 1 to 10 carbon atoms and $x$ is zero to 10.

2. A lubricant composition, as defined in claim 1, wherein said amine salt of a half-ester of a succinic acid is present in an amount of from about 0.01% to about 10%, by weight.

3. A lubricant composition, as defined in claim 1, wherein said amine salt of a half-ester of a succinic acid is present in an amount of from about 0.1% to about 5%, by weight.

4. A lubricant composition, as defined in claim 1, wherein the amine salt of a half-ester of a succinic acid is the tributylamine salt of monomethyl n-octenylsuccinic acid.

5. A lubricant composition, as defined in claim 1, wherein the amine salt of a half-ester of a succinic acid is the tributylamine salt of mono-sec-butyl tetrapropenylsuccinic acid.

6. The lubricant composition, as defined in claim 1, wherein the lubricant comprises a mineral oil-based composition.

7. A lubricant composition, as defined in claim 1, wherein the lubricant comprises a synthetic oil-based composition.

8. A lubricant composition, as defined in claim 1, wherein said composition comprises an oil of lubricating viscosity in the range from about 45 SSU at 100° F to about 6,000 SSU at 100° F.

9. A lubricant composition, as defined in claim 1, wherein said composition comprises an oil of lubricating viscosity in the range from about 50 SSU at 210° F to about 250 SSU at 210° F.

10. A lubricant composition, as defined in claim 1, wherein said lubricant comprises a grease.

* * * * *

UNITED STATES PATENT AND TRADEMARK OFFICE

CERTIFICATE OF CORRECTION

PATENT NO. : 4,100,083

DATED : July 11, 1978

INVENTOR(S) : WILLIAM R. MURPHY, ET AL.

It is certified that error appears in the above-identified patent and that said Letters Patent are hereby corrected as shown below:

| | |
|---|---|
| Column 3, line 61 | After "hexyl alcohol" insert the words --decyl alcohol,--. |
| Column 4, line 43 | "midly" should read --mildly--. |
| Column 5, line 11 | "1-hydroxystearate" should read --12-hydroxystearate--. |

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*